US008561837B2

(12) United States Patent
Giammanco

(10) Patent No.: US 8,561,837 B2
(45) Date of Patent: Oct. 22, 2013

(54) WIPES DISPENSER

(76) Inventor: Robert L. Giammanco, Clarendon Hills, IL (US)

( * ) Notice: Subject to any disclaimer, the term of this patent is extended or adjusted under 35 U.S.C. 154(b) by 25 days.

(21) Appl. No.: 13/200,017

(22) Filed: Sep. 16, 2011

(65) Prior Publication Data

US 2013/0068781 A1 Mar. 21, 2013

(51) Int. Cl.
*B65D 83/08* (2006.01)

(52) U.S. Cl.
USPC ..... 221/102; 221/312 C

(58) Field of Classification Search
USPC ..... 221/34, 45, 46, 61, 92, 97, 98, 102, 221/281, 282, 284, 287, 306
See application file for complete search history.

(56) References Cited

U.S. PATENT DOCUMENTS 1,904,777 A * 4/1933 Brzezicki ..... 206/237
5,013,099 A * 5/1991 Styles et al. ..... 312/34.4
5,042,687 A * 8/1991 McKinley ..... 221/311
6,062,422 A * 5/2000 Ellis ..... 221/45
D431,735 S * 10/2000 Sullivan ..... D6/457
6,209,184 B1 * 4/2001 Copeland et al. ..... 29/428
D464,179 S * 10/2002 Petersen et al. ..... D6/518
7,222,747 B1 * 5/2007 Savran ..... 221/34
2004/0178198 A1 * 9/2004 Lauer et al. ..... 220/23.87
2008/0223867 A1 * 9/2008 Carr ..... 221/34
2009/0223991 A1 * 9/2009 Lorenzati et al. ..... 221/34
2011/0084089 A1 * 4/2011 Maccario ..... 221/34
2011/0266299 A1 * 11/2011 Fodor ..... 221/102
2012/0032565 A1 * 2/2012 Stoop et al. ..... 312/34.4

* cited by examiner

*Primary Examiner* — Gene Crawford
*Assistant Examiner* — Kelvin L Randall, Jr.
(74) *Attorney, Agent, or Firm* — Gregory B. Beggs

(57) ABSTRACT

An upright, tubular floor stand wipes dispenser is disclosed having a body portion containing an upper compartment from which the wipes are dispensed through an orifice and a lower compartment housing a container such as a waste basket for used wipes. A cover plate conforming to the body portion and having an opening through which used wipes are deposited into the waste basket hangs from an upper edge of the body portion by clips arranged along the top edge of the plate. The stand is readily serviceable from the front and does not have to be moved when removing the used wipes.

2 Claims, 3 Drawing Sheets

WIPES DISPENSER

FIELD OF THE INVENTION

This invention relates to columnar floor stands which dispense individual hand wipes, or towelettes, from a compartment at the top of the stand and also store a container for used wipes in a lower compartment. More particularly, it relates to a dispensing stand which includes a front cover normally nested against a tubular body portion of the stand but readily separated by removing the stand's lid and lifting the cover off the stand's body portion.

BACKGROUND OF THE INVENTION

Various floor stand wipes dispensers are illustrated in the prior art. One, for example, is shown in pre-grant Publication No. 2006/0289558 A1, namely, a stand with a hinged lid which gives access to an upper compartment where dispenser packages of wipes are inserted, and a hinged door on the front of a lower compartment for servicing a wastebasket stored there. The used wipes are deposited in the wastebasket through an inlet opening in the door. Another example is shown in U.S. Pat. No. 3,414,157 directed to a litter container which is a box with a hinged lid mounted on a stand straddling a transmission hump in an automobile. The lid includes an upper compartment for wipes and a dispensing outlet in the top panel of the lid. The lower portion of the box is a collector for used wipes or other materials. U.S. Pat. No. 6,508,383 discloses a base plate vertically mounted on a door panel and supporting both an upper compartment for dispensing wipes and a lower open-ended pocket for accepting used wipes.

These patents illustrate the efforts of each of the inventors to meet the needs of situations where wipes dispensers are called for. The dispensers are serviced in a variety of ways, and access to the waste container portions likewise differs from unit to unit.

It is an object of the present invention to provide an upright front cover for a floor stand wipes dispenser which nests snugly against the columnar body portion of the dispenser without being hinged or latched to the columnar body.

It is a further object of this invention to provide an upright front cover for a floor stand wipes dispenser which utilizes its own weight to achieve a close nesting engagement to the front face of the columnar body of the dispenser.

It is a further object of this invention to provide an upright front cover for a floor stand wipes dispenser which utilizes a depending rim on a lid on the columnar body of the dispenser to hold the upright front cover closely nested against the columnar body of the dispenser.

It is a further object of this invention to provide means to conceal clips which suspend an upright front cover for a floor stand wipes dispenser on the columnar body portion of the dispenser.

It is a further object of this invention to provide a floor stand wipes dispenser having an inner compartment for a waste container and an inlet through a cover over the compartment for used wipes but discloses no means for separating the cover from the dispenser.

It is a further object of this invention to provide an upright front cover for a floor stand wipes dispenser which is readily installed or removed from the front of the dispenser without tools in order to service a waste container inside the tubular body of the dispenser.

These and other objects of the invention will become apparent after reading the description of the invention which follows.

SUMMARY OF THE INVENTION

This invention is a tubular floor stand wipes dispenser which is readily serviceable from the front of the stand and particularly allows removal of used wipes from inside the lower portion of the dispenser without moving the dispenser away from a wall or other confining structure where the stand is placed. The tubular body portion of the dispenser contains an upper compartment and a lower compartment, the upper compartment containing a supply of wipes which are dispensed by pulling them individually from a dispensing outlet, and the lower compartment containing a wastebasket or similar container for used wipes placed in the dispenser through a first inlet in the tubular body portion and a cooperative second inlet in a cover plate nested on the tubular body over the first inlet. The cover plate hangs from an upper edge of the tubular body on clips at the top edge of the cover plate, and the clips are concealed by the depending rim of a lid resting on the upper edges of the tubular body over the wipes in the upper compartment. The lid also holds the top edge portions of the cover plate against the tubular body portion of the dispenser

DETAILED DESCRIPTION OF THE PREFERRED EMBODIMENTS

Figure 1:
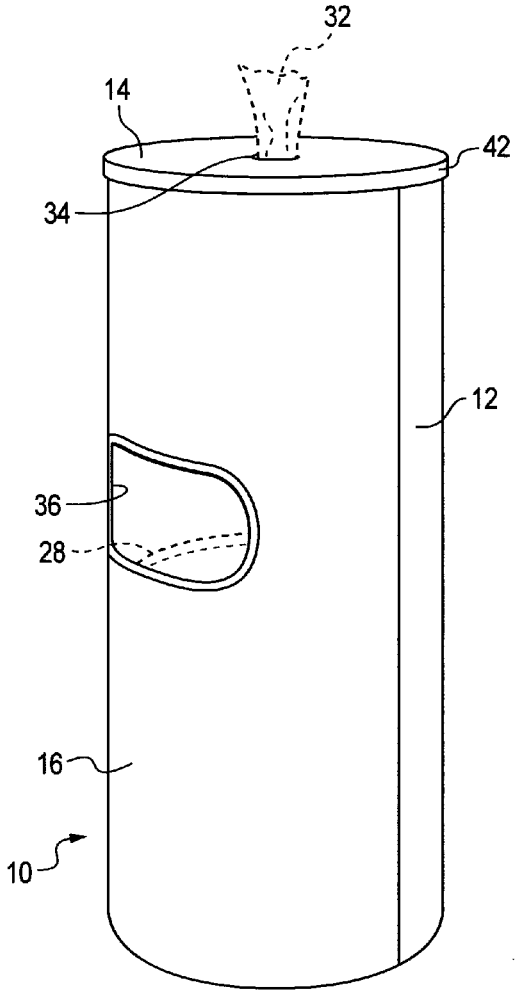
FIG. 1 is a perspective view of an assembled floor stand wipes dispenser embodying this invention and illustrating the cover plate portion of the invention nested on the tubular body portion of the dispenser.
Figure 2:
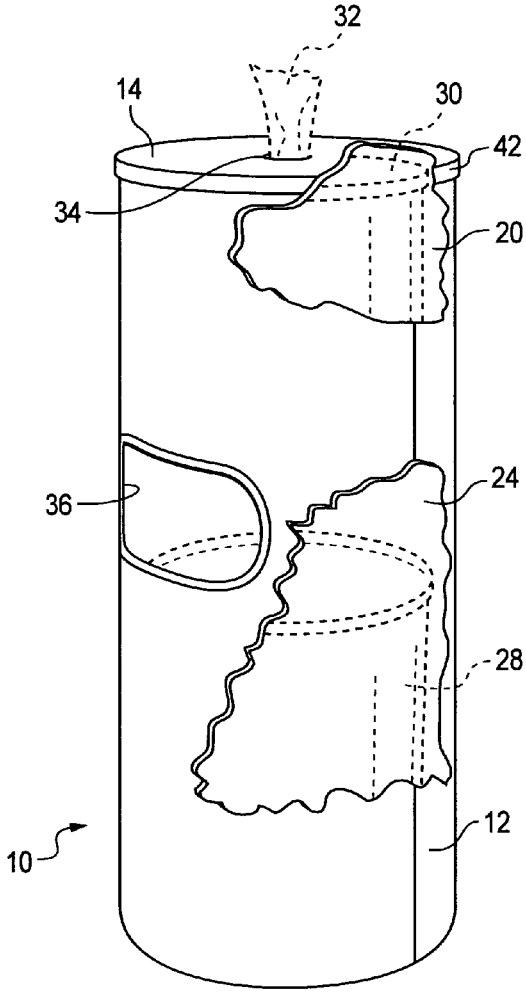
FIG. 2 is a broken away view of the floor stand wipes dispenser shown in FIG. 1 illustrating the interior of the dispenser when it is in use with a supply of wipes to be dispensed and a waste container for used wipes, both shown in phantom.

A floor stand wipes dispenser 10 which embodies the present invention is shown in FIG. 1. The dispenser has a tubular body portion 12, a lid 14 and a cover plate 16 which is nested onto and covers the front of the tubular body portion 12. As shown more particularly in FIG. 3, a shelf or deck 18 creates an upper compartment 20 inside the tubular body portion 12. Below the upper compartment 20 there is an open bottom end 22 of the tubular body portion 12, and a lower compartment 24 inside the tubular body portion 12. A first inlet 26 into the lower compartment 24 is large enough to accept a wastebasket 28 which rests inside the tubular body portion 12 on a floor or deck area beneath the tubular body portion wherever dispenser 10 is placed. Lid 14 rests on top of the tubular body portion 12, covering an upwardly facing open end of the upper compartment 20. A container 30 of wipes 32 may be placed on the upper deck 18 where they can dispensed individually through a hole 34 in the planar portion of the lid 14.

The cover plate 16 fits over and nests against the front of the tubular body portion 12 and covers the first inlet 26. A second inlet 36, formed in the cover plate 16, provides an opening through the cover plate which is registered with the first inlet 26, and, together with the first inlet 26, creates an open passageway from outside the cover plate 16 into the lower compartment 24 of the tubular body portion 12 where wastebasket 28 is located. When a person uses a wipe 32 from the supply in the upper compartment 20 of the dispenser, the registered inlets provide a means for disposing of the wipe by throwing it through the inlets into the wastebasket 28 inside the lower compartment 24.

Cover plate 16 hangs on the front of the tubular body portion 12, suspended there by clips 38 along the top edge of cover plate 16. The clips cooperatively engage the notches 40 which are located along the top edge of the tubular body portion 12. As shown, clips 38 are tabs which are integral with and folded inwardly along the upper edges of cover plate 16, spaced apart to mate with the notches 40 and not extend above the upper edges of the tubular body portion 12 when the plate 16 is set in place there. The diameter of lid 14 is slightly larger than the diameter of tubular body portion 12 so that rim 42 on the lid 14 covers and hides clips 38 and the notches 40. Those notches locate and stabilize cover plate 16 over the front of the tubular body portion 12, but when notches are not provided, clips 38 may be simply hung over the top edges of tubular body portion 12. In either case, the depending rim 42 of lid 14 provides a screen around the engagement of the cover plate 16 with the upper edges of tubular body portion 12. The rim 42, when it rests in place on the top of dispenser 10, also assists in holding the top end of cover plate 16 against the tubular body portion 12 of the dispenser.

Figure 3:
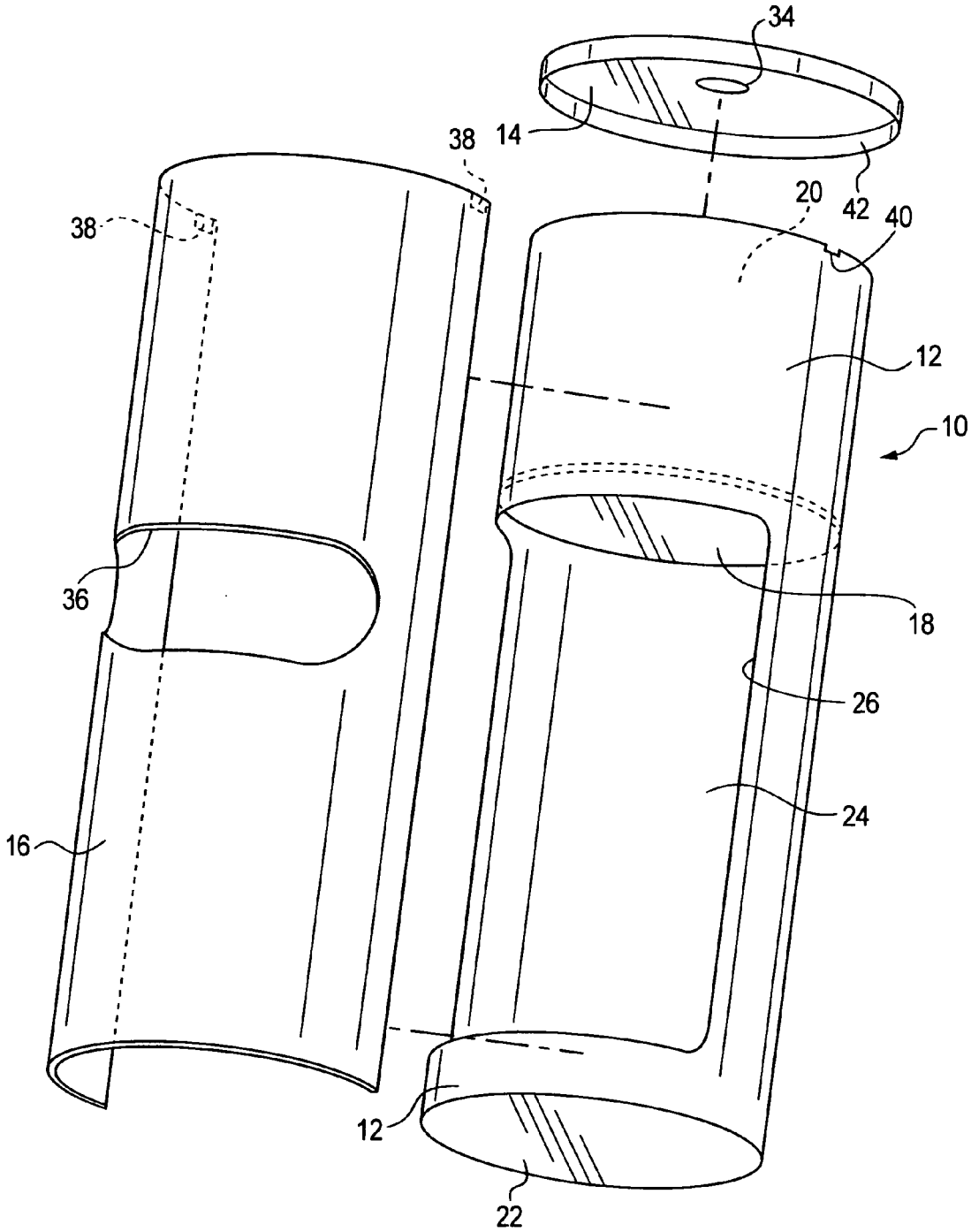
FIG. 3 is an exploded view of the floor stand wipes dispenser shown in FIG. 1.
Figure 4:
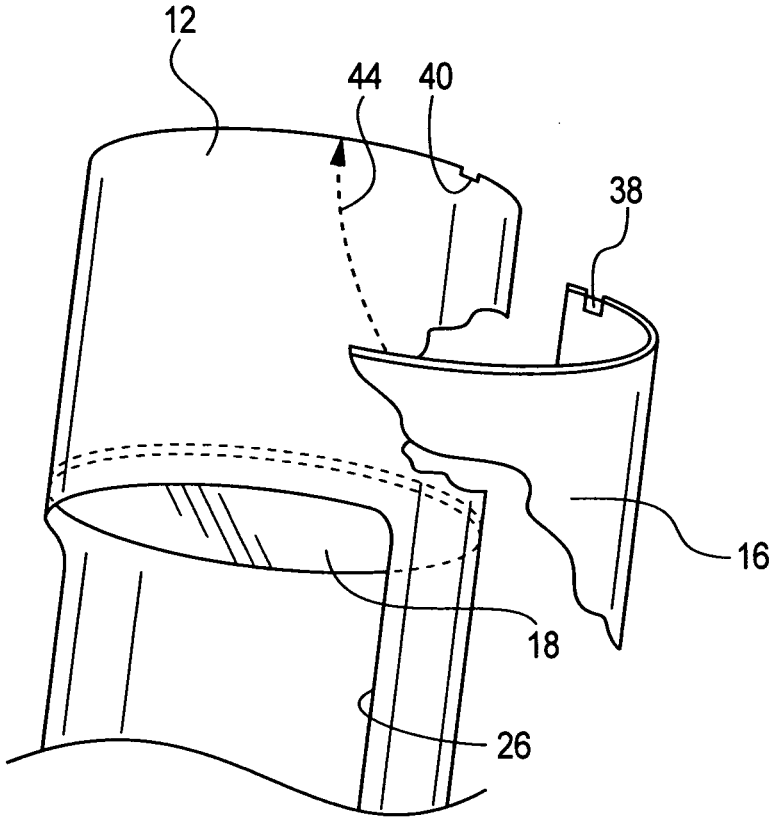
FIG. 4 is a partial view of the floor stand wipes dispenser in FIG. 3 illustrating how parts of the dispenser are assembled.

FIGS. 3 and 4 illustrate the assembly of the cover plate 16 on the front of the tubular body portion 12. Lid 14 is initially lifted up to expose the upper end of the tubular body portion 12, and then cover plate 16 is moved in the direction of arrow 44 toward the tubular body portion 12. The clips 38 are engaged in the notches 40. Cover plate 16 is configured to imitate the outside surface of the tubular body portion 12 and bring the second inlet 36 to register against the upper portion of first inlet 26, close to the underside of the upper deck 18. The tubular body portion 12 has a circular cross section which is substantially the same from the bottom of the tubular body portion to the top edges which contain notches 40. Cover plate 16 similarly has a semicircular cross section with a radius which compliments the radius of the tubular body portion 12. When the cover plate 16 is hung on the top edges of the tubular body portion 12, cover plate 16 fits over and nests upon the tubular body portion for the entire length of cover plate 16.

Various modifications of this invention can be made without departing from its true spirit and scope. Accordingly, no limitation is intended by the foregoing description, and full breadth of the invention is intended to be covered in the following claims.

I claim:

1. A floor stand dispenser for hand wipes comprising
- a tubular body portion having an upper end,
- a deck inside the tubular body portion forming an upper compartment and a lower compartment in the tubular body portion,
- a first inlet formed in the tubular body portion accessing the lower compartment,
- a plate portion having clips hooked over upper edges of the upper end of the tubular body portion suspended from the upper end of the tubular body portion and nested against an exterior surface of the tubular body portion,
- a second inlet formed in the plate portion accessing the lower compartment of the tubular body portion through the first inlet in the tubular body portion,
- a lid portion disposed on the upper end of the tubular body portion, and
- a rim on the lid portion engaged on the upper end of the tubular body portion and the plate portion.

2. The floor stand dispenser of claim 1 in which the plate portion is pivotally disposed against the tubular body portion from the clips when they are engaged on the upper end of the tubular body portion.

* * * * *